United States Patent [19]

Jones

[11] Patent Number: 4,909,177

[45] Date of Patent: Mar. 20, 1990

[54] INFLATABLE BOAT SEAT

[76] Inventor: Robert S. Jones, 1151 Walnut Ave., #31, Tustin, Calif. 92680

[21] Appl. No.: 271,495

[22] Filed: Nov. 15, 1988

[51] Int. Cl.[4] ..... A49B 19/00

[52] U.S. Cl. ..... 114/345; 114/363; 297/232

[58] Field of Search ..... 114/345, 363, 343; 441/40, 44, 45, 130, 131, 132; 297/232

[56] References Cited

U.S. PATENT DOCUMENTS

| | | | |
|---|---|---|---|
| 2,124,062 | 7/1938 | Grant et al. | 441/40 |
| 2,468,287 | 4/1949 | Bohler | 114/345 |
| 4,696,251 | 9/1987 | Spieldiener et al. | 114/363 |
| 4,795,387 | 1/1989 | Morgan | 441/130 |

*Primary Examiner*—Sherman D. Basinger
*Assistant Examiner*—Edwin L. Swinehart
*Attorney, Agent, or Firm*—Stetina and Brunda

[57] ABSTRACT

A seat for an inflatable boat is disclosed characterized by use of an elongate beam member adapted to support a user thereon and a pair arcuate end panels sized to extend about the tubular side walls of the inflatable boat and securely affix the seat at any desired position within the interior of the inflatable boat. The end panels are formed having an arcuate configuration generally complimentary to the interior portion of the tubular side walls of the inflatable boat to frictionally engage the same and may be removeably mounted to the elongate beam portion to allow compact stowage of the seat with the inflatable boat as desired.

13 Claims, 2 Drawing Sheets

INFLATABLE BOAT SEAT

FIELD OF THE INVENTION

The present invention relates generally to seat constructions and more particularly to a seat for an inflatable boat characterized by use of an elongate beam member adapted to support a user thereon and a pair of arcuate end panels sized to extend about the tubular side walls of the inflatable boat and securely affix the seat at any desired position within the interior of the inflatable boat.

BACKGROUND OF THE INVENTION

As is well known, inflatable boats are commonly utilized for sporting and recreational activities both in the United States and in foreign countries. Such inflatable boats oftentimes prove advantageous to rigid hull boats due to their reduced weight and cost as well as their ability to be stowed in a compact configuration and thereby be readily transported to a desired, even remote location for use. Such prior art inflatable boats have generally incorporated either a fixed bench seat or an inflatable movable seat for accommodating the user or users within the interior of the inflatable boat.

The prior art bench seats have typically comprised a wooden plank which extends transversely across the top of the tubular side walls of the inflatable boat being affixed thereto by way of releasable fasteners such as hook and loop (brand name) fasteners or alternatively affixed to plural cleats or straps formed on the tubular side walls of the boat. As such, the prior art bench seats are positionable only in fixed locations upon the inflatable boat and thereby cannot readily accommodate differing seating locations or positions desired for proper single and/or multiple occupant use of the inflatable boat. Further, such wooden bench seat construction is susceptible to degradation caused by prolonged exposure to environmental conditions.

The prior art inflatable seats generally comprise lightweight rectangular air cushions which may be placed at any desired position within the interior of the inflatable boat. However, such prior art inflatable seats typically fail to provide sufficient support for the user within the inflatable boat, and oftentimes move relative to the boat during use, thereby posing a possible safety hazard to the user. In addition, such inflatable seats, if not sat upon by a user during boating applications, possess a high tendency of becoming jettisoned from the inflatable boat requiring retrieval by the user.

As such, there exists a substantial need in the art for an improved seat for an inflatable boat that may be positioned at any location within the inflatable boat to readily accommodate both single and/or multiple occupant use; provides firm, rigid support for the occupant users and is securely retained within the inflatable boat throughout use so as not to inadvertently jettisoned therefrom.

SUMMARY OF THE PRESENT INVENTION

The present invention specifically addresses and alleviates the above reference deficiencies associated in the prior art. More particularly, the present invention comprises a seat for an inflatable boat characterized by use of an elongate beam member or portion adapted to firmly support a user thereon, and a pair of arcuate end panels or portions sized to extend about the tubular side walls of the inflatable boat and securely affix the seat at any desired position within the interior of the inflatable boat. The end portions of the seat are formed in an arcuate configuration having a radius generally complimentary to the radius of the tubular side walls of the inflatable boat to frictionally engage the same during use. Additionally, the arcuate end portions are sized to extend a short distance below the lower portion of the tubular side walls of the inflatable boat so as to prevent any possibility of the seat from being jettisoned from the inflatable boat during use.

In the preferred embodiment, the seat is formed in a three piece construction, i.e. the elongate beam portion and the pair of arcuate end portions which may be detachably mounted to one another to facilitate compact stowage of the seat within the inflatable boat as desired.

Additionally, in the preferred embodiment, the elongate beam portion and arcuate end portions of the seat are formed of fiberglass to possess sufficient strength and resist environmental degradation throughout applicational use. The fiberglass construction additionally accommodates the use of urethane foam and/or wood core inserts to be disposed therewithin to provide flotation for the seat as well as increased structural strength.

In a first preferred embodiment of the present invention, the arcuate end portions are formed having a width sufficient to frictionally engage the tubular side walls of the inflatable boat at any desired location within the interior of the inflatable boat and support the user thereupon. In a second preferred embodiment of the invention, the width of the arcuate end portions are reduced so as to be inserted and received within conventional seat straps or cleats formed on many of contemporary inflatable boat configurations. As such, the present invention can be effectively utilized for retrofitting existing inflatable boat designs as well as be incorporated therein directly at the time of manufacture.

DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
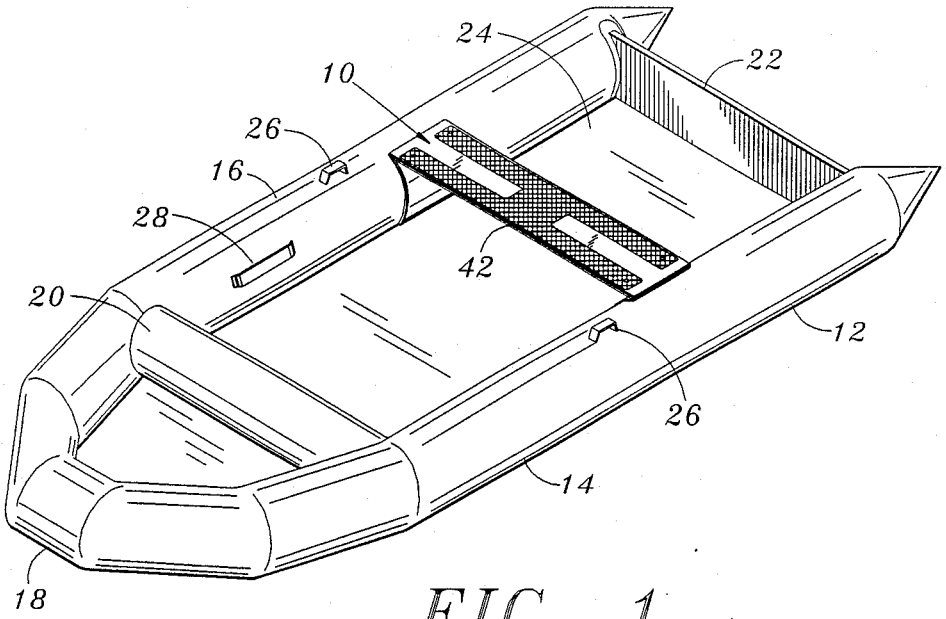
FIG. 1 is a perspective view of an inflatable boat having the improved seat of the present invention disposed therein.

Referring to FIG. 1, there is shown the inflatable boat seat of the present invention designated generally by the numeral 10 disposed in an operative embodiment within the interior of a conventional inflatable boat 12. Such inflatable boats are well known in the art being manufactured by various concerns such as Zodiac, Avon and Metzler.

Although such inflatable boats differ slightly in construction, they all include a pair of inflatable tubular side walls 14 and 16 that extend from the aft of the boat 12 toward the bow of the boat 12. As is typical, the tubular side walls 14 and 16 are joined by a tubular bow section 18 and may additionally include an additional inflatable tubular section 20 extending therebetween to provide increased structural rigidity for the boat 12. The aft of the boat 12 includes a rigid transom 22 extending between the tubular side walls which additionally engages the flooring 24 of the inflatable boat 12. As is conventional, a pair of oar mounts 26 are provided on the upper portion of the tubular side walls 14 and 16 and, in some instances, one or more straps 28 may be provided on the interior portion of the tubular side walls 14 and 16 which permit the affixation of a prior art bench seat (not shown) to be positioned within the interior of the inflatable boat 12.

Figure 2:
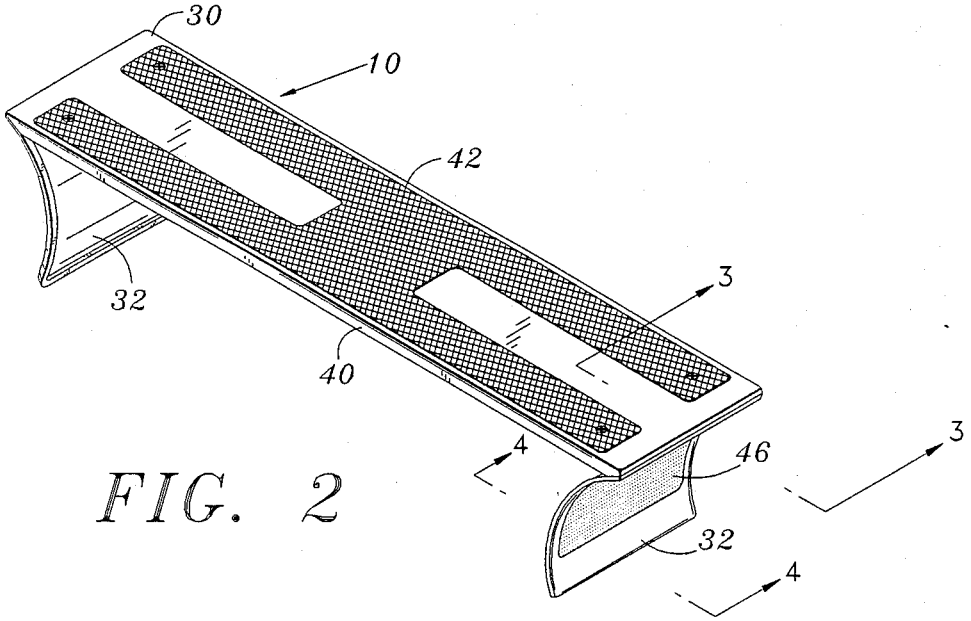
FIG. 2 is a perspective view of the inflatable boat seat of the present invention.
Figure 3:
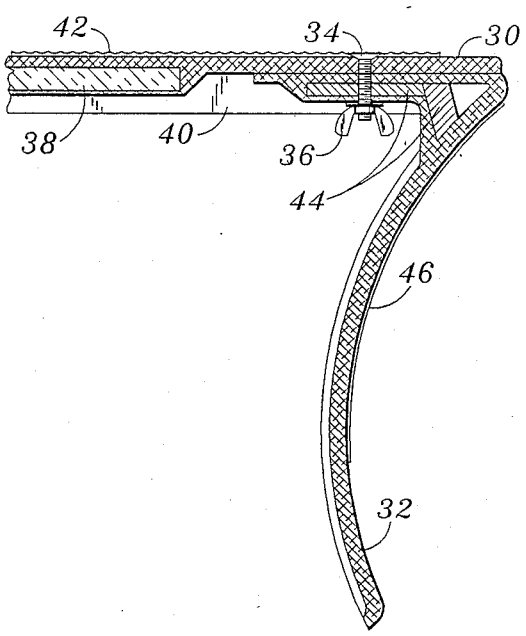
FIG. 3 is a cross sectional view of the inflatable boat seat of the present invention taken about lines 3—3 of FIG. 2 and depicting the internal core insert structure thereof.

Referring more particularly to FIGS. 2 and 3, the seat 10 of the present invention is preferably formed having an elongate beam member or portion 30 and a pair of arcuate shaped end panels or portions 32 which extend downwardly from the undersurface of the beam portion 30. In the preferred embodiment, the beam portion 30 and pair of end portions 32 are fabricated from fiberglass with the end portions 32 preferably but not necessarily being releasably mounted to the beam portion 30 by way of plural threaded fasteners and thumb screws 34 and 36 respectively. As such, the seat 10 is specifically constructed to withstand environmental exposure without decay and allow rapid detachment and attachment of the end panels 32 to the beam portion 30 for compact stowage and rapid deployment respectively.

In the preferred embodiment, the elongate beam portion 30 is formed as a rigid member and includes an elongate insert 38 disposed within its interior which preferably is formed from a rigid closed cell polyurethane foam material The particular insert 38 thereby adds structural rigidity to the beam portion 30 as well as provides flotation means for the same. Additionally, the beam portion 30 is preferably formed having a pair of structural side rail portions 40 extending throughout its length for increased structural strength as well as a non-skid surface configuration 42 formed on its upper surface.

The arcuate end portions 32 additionally are provided with a structural insert 44 preferably formed of wood, such as plywood, which is disposed within the interior of the upper regions of the end portions 32 to provide added structural strength. In the preferred embodiment the insert 44 is formed of two pieces of plywood which are disposed in a generally L-shaped orientation which additionally provides flotation for the end panels 32. The exterior surface of the end panels 32 is preferably formed having a concave arcuate configuration the radius of which is sized to be complimentary to or substantially equal to the radius of the tubular side walls 14 and 16 of the inflatable boat 10. The arcuate length of the end portions 32 is additionally sized to cover a sector of approximately 90 degrees of the tubular side walls 14 and 16 to securely anchor the seat 10 within the inflatable boat 12 in a manner to be described in detail infra. The exterior surface of the end portions 32 is additionally provided with a thin planar applique 46 preferably formed of an elastomeric material, such as rubber, to increase frictional engagement between the end portions 32 and the tubular side walls 14 and 16 of the inflatable boat 12.

Figure 4:
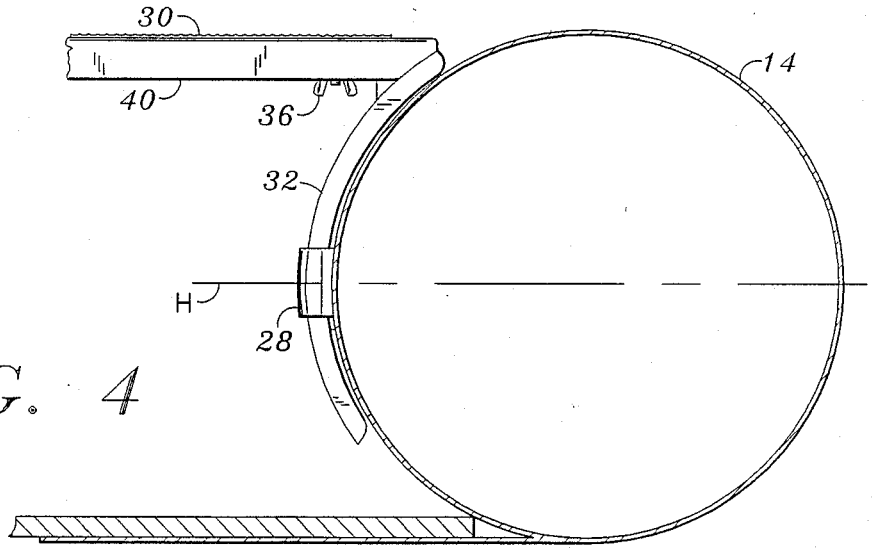
FIG. 4 is a cross sectional view of the inflatable boat seat of the present invention taken about lines 4—4 of FIG. 2 illustrating the spatial relationship between the inflatable boat seat of the present invention and the tubular side walls of the inflatable boat.

As best shown in FIG. 4, the seat 10 of the present invention may be installed within the boat 12 by initially assembling the end portions 32 to the beam portion 30 by way of the plural threaded fasteners 34 and thumb screws 36 and subsequently positioning the seat 10 at any location within the interior of the boat 12 in an orientation transverse or extending between the side walls 14 and 16. When disposed in its desired position within the interior of the boat 12, the arcuate end portions 32 abut the interior portion of the side walls 14 and 16 in a generally contiguous orientation.

As will be recognized, with the seat 10 disposed within the interior of the boat 12, the planar appliques 46 formed on the exterior surface of the arcuate end portions 32 of the seat 10 frictionally engage the interior portion of the side walls 14 and 16 and hence prevent any inadvertent lateral slippage of the end portions 32 relative to the side walls 14 and 16. Additionally, as best shown in FIG. 4, due to the arcuate length of the end portions 32 of the seat 10 extending downwardly onto the lower portion of the interior surfaces of the tubular side walls 14 and 16 (i.e., below the horizontal plane H designated in FIG. 4), the end portions 32 are frictionally captured so as to resist upward vertical movement between the tubular side walls 14 and 16 and are thereby securely affixed in a desired position within the interior of the boat 12. In this regard it will be recognized that due to the capturing of the end portions 32 beneath the lower portion of the tubular side walls 14 and 16, the resilient biasing force exerted by the inflated tubular side walls 14 and 16 upon the arcuate end portions 32 serve to retain the seat 10 in a desired position. Further, it will be recognized that due to the interaction of the side walls 14 and 16 with the arcuate end portions 32, the seat 10 may be positioned at any location within the interior of the boat 12 and be securely affixed thereto without the need for any auxiliary fasteners.

Figure 5:
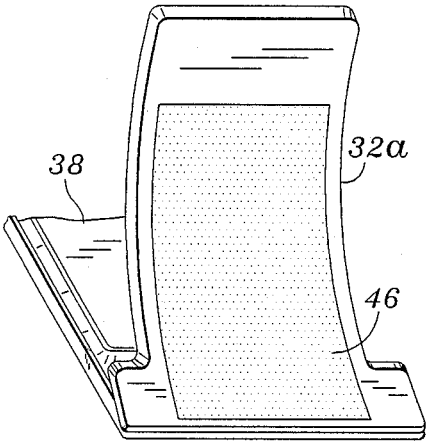
FIG. 5 is a partial perspective view of a second embodiment of the inflatable boat seat of the present invention depicting a modified end panel or portion for engagement with strap cleats formed on the tubular side walls of an inflatable boat.

Referring to FIG. 5, a second embodiment of the inflatable boat seat 10 of the present invention is depicted. In this second embodiment, the end portions 32A are fabricated in a manner analogous to that described in relation to the embodiment depicted in FIGS. 1–4 except that the lower portions of the same are reduced in width forming a generally T-shaped arcuate end portion 32A. Preferably, this reduced width is sized to be equal to or slightly less than the distance between opposite ends of the conventional prior art seat straps 28 (shown in FIG. 1) formed on some conventional inflatable boats. As such, the end portions 32A may be inserted through the straps 28 to be further retained in a desired position within the interior of the boat 12. The extension of the end portions 32A is depicted in FIG. 4 wherein the strap 28 formed on the side walls 14 and 16 of the inflatable boat 12 is shown encircling the end portions 32A of the second embodiment of the inflatable boat seat 10.

As will be recognized, although for purposes of the preferred embodiment, various configurations, materials, and orientations have been defined herein, various modifications to the same can be readily made without departing from the spirit of the present invention and such modifications are clearly contemplated herein.

What is claimed is:

1. A seat for an inflatable boat having spaced tubular side walls comprising:

an elongate member sized to extend between the spaced tubular sidewalls of the inflatable boat;

a pair of end panels disposed adjacent opposite ends of said elongate member, said pair of end panels formed having a concave arcuate configuration generally complimentary to the arcuate configuration of said tubular side walls and a length sufficient to extend onto the lower portion of said tubular side walls to abut said side walls in a generally contiguous orientation and be frictionally captured by said tubular side walls to secure the seat to the inflatable boat;

said pair of end panels being releasably mounted to said elongate member and being formed of fiberglass; and wherein said pair of end panels are formed having a core insert to provide for flotation.

2. The seat of claim 1 wherein said pair of end panels each include an applique adapted to increase friction between said pair of end panels and said tubular side walls.

3. The seat of claim 2 wherein said applique is formed of an elastomeric material.

4. The seat of claim 1 wherein said elongate member is formed of fiberglass.

5. The seat of claim 4 wherein said elongate member is formed having a core insert to provide flotation.

6. The seat of claim 5 wherein said core insert is formed of a rigid polyurethane foam material.

7. The seat of claim 1 wherein said core insert is formed of wood.

8. The seat of claim 1 wherein said elongate member is formed having a pair of side rails extending along its length.

9. The seat of claim 8 wherein one surface of said elongate member includes a non-skid surface configuration.

10. A seat for an inflatable pontoon boat having a bow section, transom section, flooring, and an elongate spaced tubular side walls comprising:

an elongate member comprising a seating surface sized to extend between the spaced tubular side walls of the inflatable pontoon boat at differing selected locations along the length of the tubular side walls; and a pair of end panels disposed adjacent opposite ends of said elongate member, said pair of end panels formed having a concave arcuate configuration generally complimentary to the arcuate configuration of said tubular side walls to abut said side walls in a generally contiguous orientation and be frictionally captured by said tubular side walls to secure the seat to the inflatable boat.

11. The seat of claim 10 wherein said pair of end panels each include an applique adapted to increase friction between said pair of end panels and said tubular side walls.

12. The seat of claim 11 wherein said applique is formed of an elastomeric material.

13. The seat of claim 10 wherein said elongate member is formed to provide flotation.

* * * * *